US005125543A

United States Patent [19]

Rohrabacher et al.

[11] Patent Number: 5,125,543

[45] Date of Patent: Jun. 30, 1992

[54] SQUEEZE TYPE BOTTLE INCLUDING ANTI-SYPHON DEVICE

[76] Inventors: Cliff Rohrabacher, R.D. #2, Box 81, Charlestown Rd., Hampton, N.J. 08827; Donald Albert, 68 Morris Hubbard Rd., Higganum, Conn. 06441

[21] Appl. No.: 678,712

[22] Filed: Apr. 1, 1991

[51] Int. Cl.[5] ..... B65D 37/00

[52] U.S. Cl. ..... 222/211; 222/212; 222/500

[58] Field of Search ..... 222/209, 211, 212, 215, 222/376, 402.18, 402.19, 464, 500

[56] References Cited

U.S. PATENT DOCUMENTS 2,531,745 11/1950 Schopmeyer ..... 222/215
2,577,321 12/1951 Filger ..... 222/464
2,578,907 12/1951 Tupper ..... 222/215
4,821,924 4/1989 Kozam ..... 222/211

FOREIGN PATENT DOCUMENTS 401491 2/1970 Australia ..... 222/215

*Primary Examiner*—Donald T. Hajec
*Assistant Examiner*—Philippe Derakshani
*Attorney, Agent, or Firm*—Anthony F. Cuoco

[57] ABSTRACT

A squeeze-type bottle of the type containing a liquid, a syphon tube extending within the liquid and a nozzle communicating with the syphon tube includes an anti-syphon device disposed between the syphon tube and the nozzle, whereby expulsion of the liquid due to a pressure differential between the inside and the outside of the bottle when the bottle is not being used is prevented. The anti-syphon device is such that the bottle may be used in an inverted position.

6 Claims, 4 Drawing Sheets

SQUEEZE TYPE BOTTLE INCLUDING ANTI-SYPHON DEVICE

BACKGROUND OF THE INVENTION

Wash bottles used in laboratories and the like include a compliant container which is squeezed, whereby liquid in the container which may be volatile or toxic is expelled therefrom through a syphon tube extending within the container and into the liquid. The syphon tube communicates with a dispensing nozzle. The dispensing nozzle is preferably but not necessarily integral with a cap for the container.

Prior to the present invention, bottles of the type described have suffered from a syphoning effect. That is to say, whenever there is a pressure differential between the inside and the outside of the bottle, the liquid in the container flows through the syphon tube and nozzle so as to drip or squirt out of the bottle, tending to equilibrate the inside and outside pressures. This can occur if the bottle is on a storage shelf or is otherwise not being used, and the aforementioned pressure differential occurs as by opening or closing a door in an atmospherically controlled room in which the bottle is kept, or when an air conditioning system for the room is turned on or off, as the case may be. When the contents of the bottle are volatile or toxic as aforenoted, a hazard, or at best a clean up problem, can occur.

The present invention avoids the noted syphoning effect, thereby achieving pressure equilibrium without expulsion of the contents of the bottle.

The applicants herein are aware of the following patents which generally relate to the field of the present invention: U.S. Pat. No. 4,600,130 which issued on Jul. 15, 1986 to Libit; U.S. Pat. No. 4,420,101 which issued on Dec. 13, 1983 to O'Neill; U.S. Pat. No. 4,133,457 which issued on Jan. 9, 1979 to Klassen; U.S. Pat. No. 3,118,573 which issued on Jan. 21, 1964 to Johnson; U.S. Pat. No. 4,102,476 which issued on Jul. 25, 1978 to Loeffler; and U.S. Pat. No. 4,057,177 which issued on Nov. 8, 1977 to Laauwe.

The patent to Libit relates to a squeeze type container and cap, wherein the container has an integral section forming a tube extending from within the container to the container neck opening. The cap has a stopper portion closing a filling part of the container neck opening and has a dispensing orifice in communication with the tube portion of the container. The invention appears to relate to increasing the internal pressure within the container.

The patent to O'Neill relates to a self-venting dispensing closure for a squeeze bottle and includes a cap containing a fluid opening. A flexible disc on the cap contains a fluid bore which defines with the opening a single fluid passageway. The cap includes an annular wall defining a valve seat upstream of the fluid opening in the direction of fluid flow through the passageway. The disc has an annular valve thereon in engagement with the valve seat in a closed position of the passageway, and the valve is shiftable along the annular wall to positions respectively upstream and downstream of the valve seat in response to pressures below and above atmospheric pressures within the bottle. In these shifted positions, the valve opens respectively into bottle venting and dispensing positions.

The patent to Klassen relates to a squeeze bottle with a sealing arrangement which prevents spillage of the contents of the bottle due to accidental dropping or tipping over. To this end the bottle has a resilient septum spanning a dispenser outlet and sealed in place by a cap. The septum has a slit which defines a flexible valve flap integrally joined along a hinged lined area to the septum for outward deflection of the flap by internal liquid pressure when the dispenser is squeezed. The septum is also formed with at least one hole, preferably on or near the vicinity of the hinge line area to increase flexibility of the flap, and to serve as a vent to greatly accelerate relaxation and normalization of the squeeze bottle wall.

The patent to Johnson relates to a squeeze bottle and provides a fluid seal for safely retaining the fluid and which functions to release the fluid upon squeezing of the bottle. The seal appears to be in the form of a rupturable diaphragm.

The patent to Loeffler relates to a squeeze bottle with an air check valve on its cover. The bottle dispenser has an air return flow path therethrough and a valve therein opening the air return flow path when the pressure on the outside of the container is greater than the pressure on the inside of the container. Actually, the object of the invention is to provide a squeeze bottle dispenser in which the flow passages for both the liquid to be dispensed and the air compressed for atomizing said liquid will automatically close by a single valve means at the conclusion of the operation of the device.

The patent to Laauwe relates to a squeeze bottle with a valve comprising two parts cooperatively forming a chamber into which a viscous product can be squeezed by squeezing the bottle to elastically separate the parts which together form a sleeve valve opened by the separation of the parts, and which recloses when the bottle squeeze pressure is released so the parts return. One of the parts forms a check valve permitting entrance of air into the bottle.

It will be apparent from the following description of the present invention that none of the aforementioned patents teach or suggest the particular structural relationship herein disclosed.

SUMMARY OF THE INVENTION

This invention contemplates a squeeze type bottle including an anti-syphon device. The bottle includes a container for a liquid and a cap for the container having a dispensing nozzle preferably but not necessarily integral therewith. The container is of a compliant plastic material or the like so that when used the container is squeezed to force liquid out of the container through a syphon tube extending within the liquid and in communication with the dispensing nozzle. The anti-syphon device includes an adapter disposed between the syphon tube and the dispensing nozzle, and which adapter has a hole extending transversely through at least one side thereof, and a collar which fits loosely over the adapter so as to cover the hole when the top of the bottle extends generally upwardly. When a pressure differential exists between the inside and the outside of the bottle the anti-syphon device is effective for preventing the liquid from being expelled through the syphon tube and the dispensing nozzle when the bottle is not being used. The bottle is usable in the inverted position, i.e. when the bottle extends generally downwardly, since in this position the collar slides away from the adapter hole to uncover said hole, whereby the contents of the bottle are dispensed through the hole and out of the bottle by squeezing the container.

DETAILED DESCRIPTION OF THE INVENTION

Figure 1:
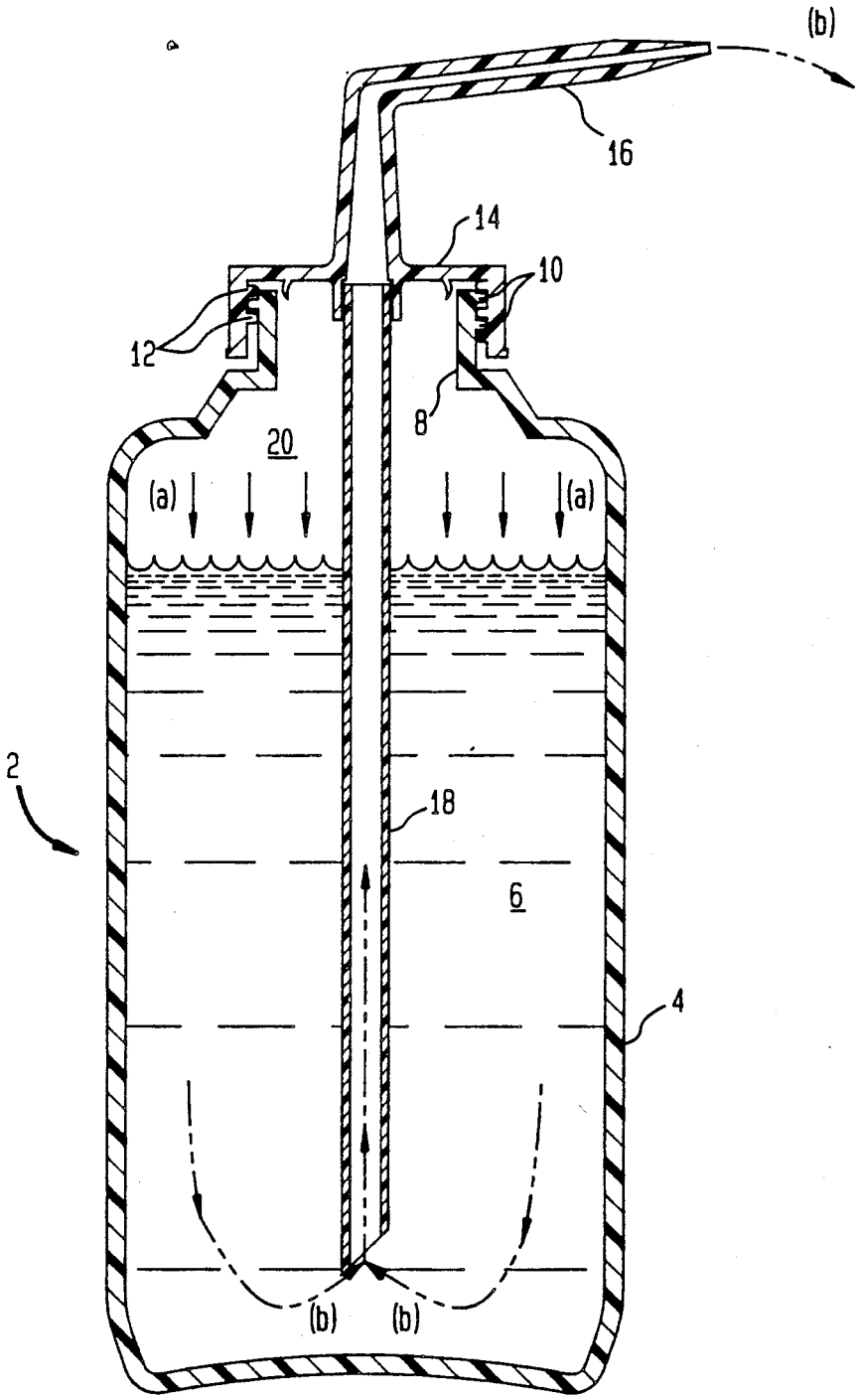
FIG. 1 (PRIOR ART)
FIG. 1 is a diagrammatic sectional elevation view showing a prior art squeeze type bottle.

With reference to the drawings, a bottle of the type contemplated is designated by the numeral 2. Bottle 2 is of a compliant plastic material such as polyethylene.

Bottle 2 includes a container portion 4 which contains a liquid 6. Liquid 6 may be a chemical detergent or reagent as may be used in a laboratory or the like. Container portion 4 includes a neck portion 8 having external threads 10 which mate with the internal threads 12 of a cap 14, and which cap 14 closes container 4.

Cap 14 includes a dispensing nozzle portion 16 which extends through neck portion 8. A syphon tube 18 extends within container portion 4 into liquid 6 and communicates with nozzle portion 16. The volume of container portion 4 designated by the numeral 20 above liquid 6 contains air. Nozzle portion 16 is preferably (as shown) but not necessarily integral with cap 14.

With bottle 2 of a compliant material such as aforenoted, liquid 6 is dispensed as by squeezing container portion 4, whereby liquid 6 flows through syphon tube 18 and out through nozzle portion 16.

With the prior art arrangement shown in FIG. 1, liquid volume 6 is involved whenever there is a pressure differential between atmospheric pressure (outside of bottle 2) and air volume 20 (within bottle 2). It will be observed that there is no direct path for air to pass for equilibrating the air pressure outside and inside the bottle. When the pressure differential is such that the pressure inside the bottle is greater than atmospheric pressure, as may occur due to an environmental change such as opening or closing a door in a room in which bottle 2 is stored, or turning air conditioning in the room on or off, liquid 6 is pressed downwardly within container portion 4 as shown by arrows (a) and up syphon tube 18 as shown by arrows (b) out of nozzle 16 so as to cause an undesirable dripping or squirting of liquid 6, as the case may be, without the bottle actually being used, i.e. container portion 4 squeezed. When liquid 6 is volatile or toxic, a hazardous or at best a clean up problem, is presented.

Figure 2:
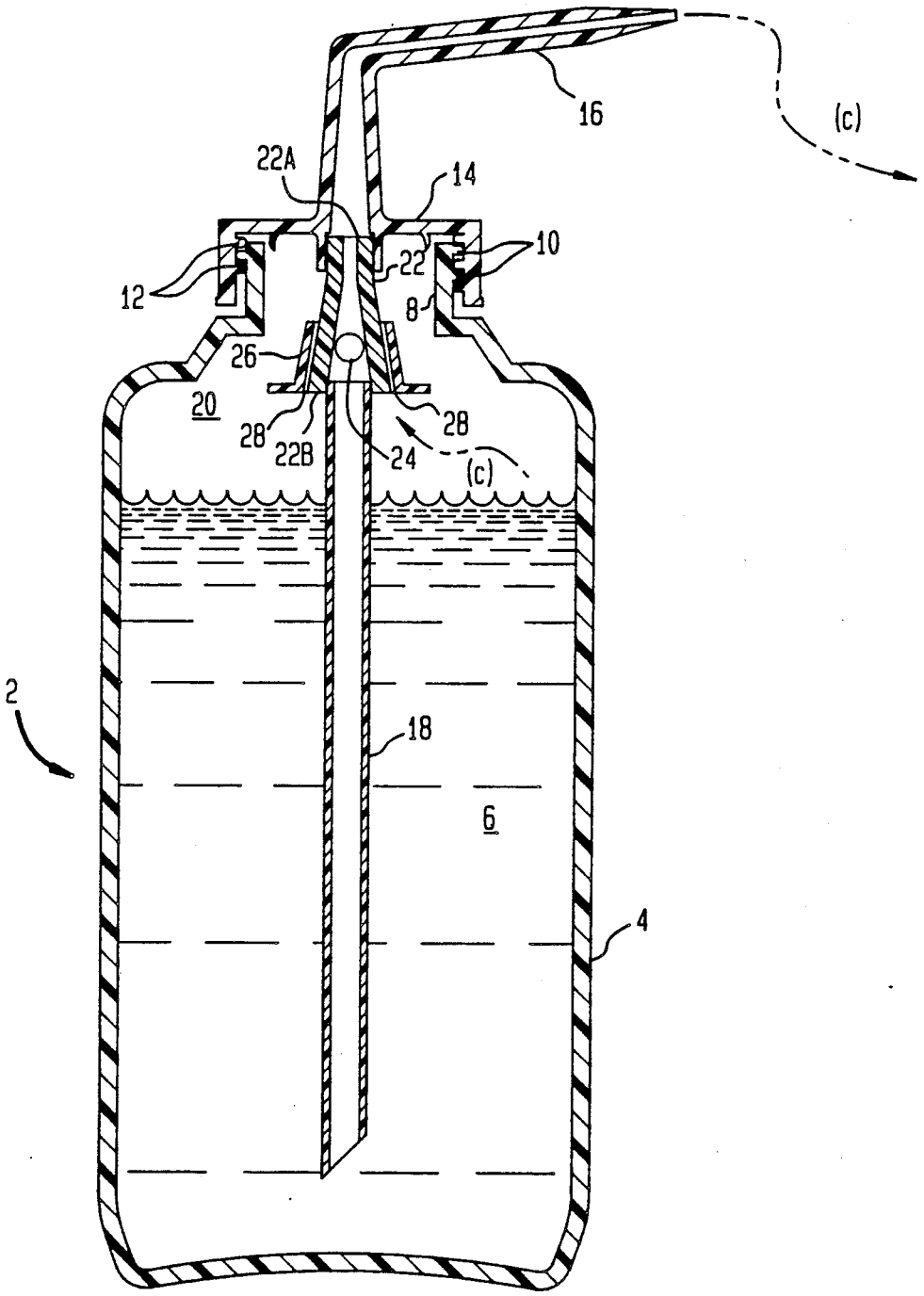
FIG. 2 is a diagrammatic sectional elevation view showing a squeeze type bottle including an anti-syphon device according to the invention.

This disadvantage is obviated by an anti-syphon device as illustrated in FIG. 2.

Thus, with particular reference to FIG. 2, the anti-syphon device includes an adapter 22 disposed between nozzle portion 16 and syphon tube 18. Adapter 22 includes a linear portion 22A which is in communication with nozzle portion 16 and a downwardly extending outwardly tapering portion 22B which is in communication with syphon tube 18. This particular configuration is for illustrative purposes only and other configurations can be used as well. A hole 24 extends transversely through at least one side of tapering portion 22B near the lowermost end thereof.

A collar 26 fits loosely over adapter 22 and is retained thereon by tapering portion 22B. When the top of bottle 2 extends generally upwardly, collar 26 covers hole 24. The arrangement is such that a space 28 extends circumferentially between adapter portion 22B and collar 26.

Figure 4:
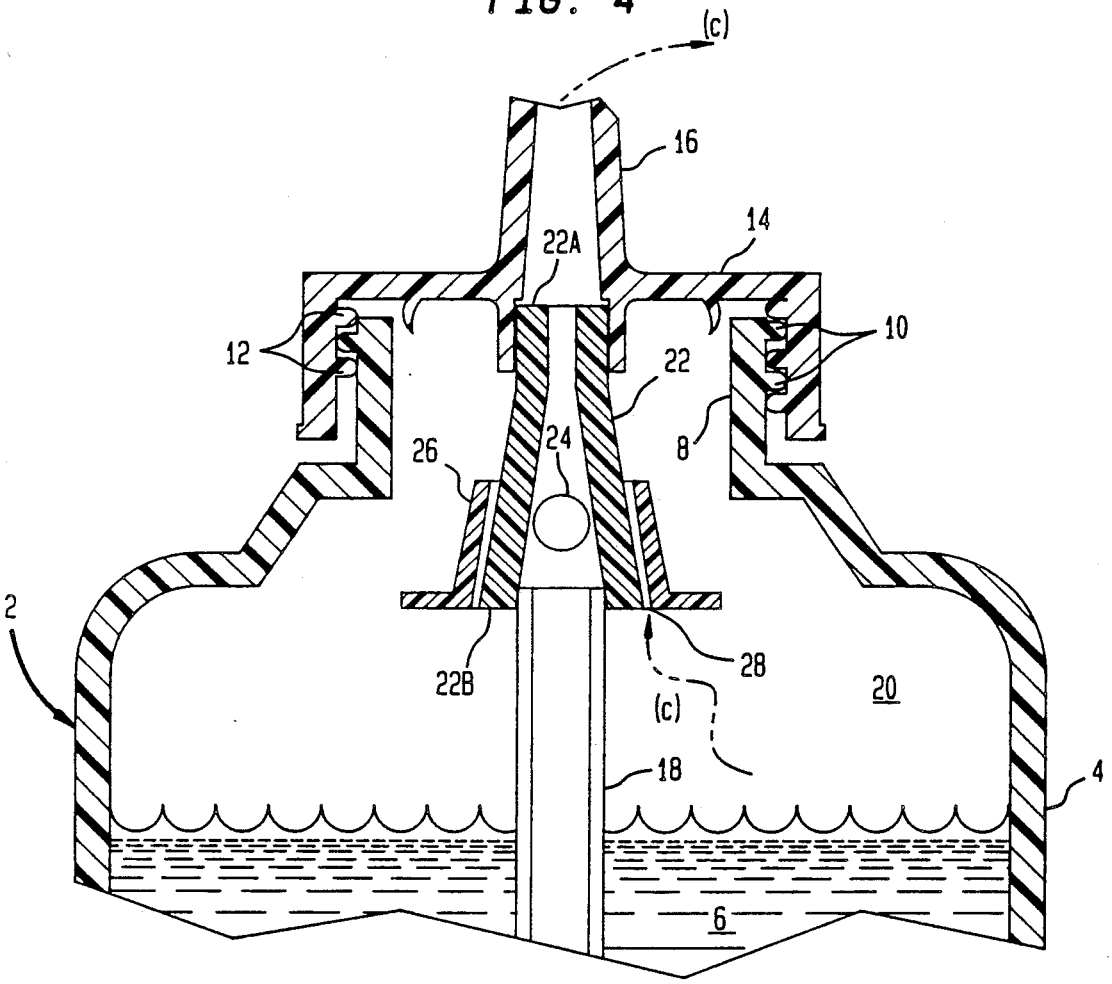
FIG. 4 is an enlarged fragmentary diagrammatic sectional elevation view showing a squeeze type bottle including an anti-syphon device according to the invention.

It will now be appreciated that as (barometric) pressure rises or falls, air volume 20 within bottle 2 tends to seek a pressure equilibrium condition. This occurs by venting of air through space 28 and hole 24 as shown by arrow (c), allowing air to pass out of the bottle without interactivity with liquid 6 and thereby preventing the liquid from traveling up syphon tube 18 and out of the bottle through nozzle 16 when the bottle is not in use. This particular feature of the invention is more clearly illustrated in the enlarged view of FIG. 4.

Figure 3:
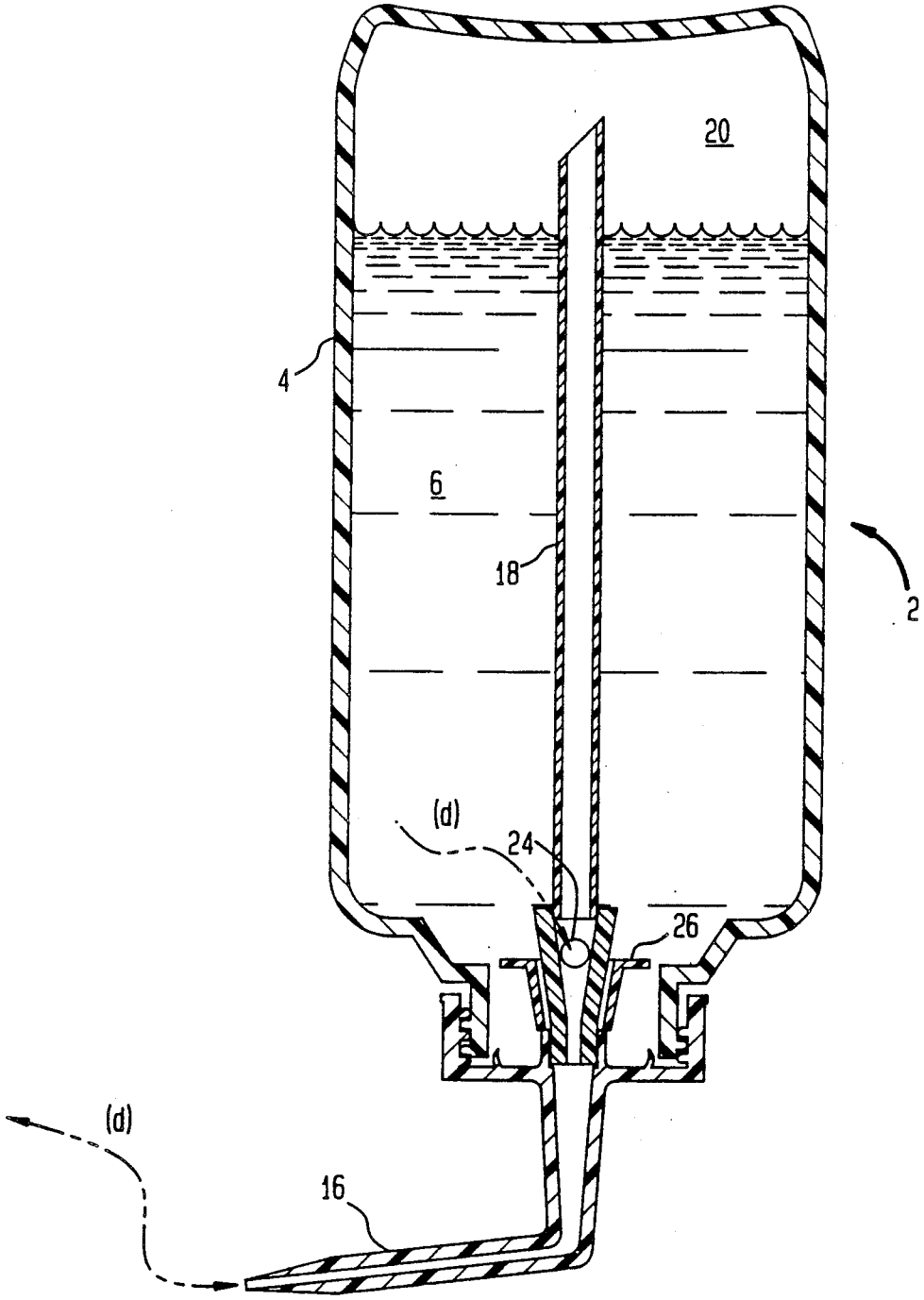
FIG. 3 is a diagrammatic sectional view showing a squeeze type bottle including an anti-syphon device according to the invention, and wherein the bottle is shown in the inverted position.

FIG. 3 illustrates an important feature of the invention wherein bottle 2 is usable with the anti-syphon device when the bottle is inverted as shown, i.e. the top of the bottle extends generally downwardly.

Thus, when the bottle is inverted, liquid 6 may be squeezed out via syphon tube 18 and nozzle 16 by the path created when collar 26 slides downward, thereby exposing hole 24. A path of least resistance as shown by arrow (d) is thus created for dispensing liquid 6 when container 4 is squeezed.

There has thus been described a squeeze type bottle of the type including a syphon tube extending into liquid within the bottle, and whereby the liquid is dispensed by squeezing the bottle to force liquid through the syphon tube and out of a nozzle in communication with said syphon tube. A situation exists in that, due to changes in pressure, liquid is expelled through the syphon tube and the nozzle in communication therewith when the bottle is not being used, i.e. squeezed. The present invention features an anti-syphon device disposed between the syphon tube and the nozzle which eliminates this condition. Further, the anti-syphon device is arranged so that the bottle is usable when in an inverted position as is desirable.

With the above description of the invention in mind, reference is made to the claims appended hereto for a definition of the scope of the invention.

What is claimed is:

1. A squeeze type bottle, comprising:

a compliant container for a liquid;

a cap for the container;

a nozzle arranged with the cap so as to provide an opening to the container;

anti-syphon means including an adapter member in communication with the nozzle above the liquid, a hole extending transversely through at least one side of the adapter member, and a collar member surrounding the adapter member so that a space extends circumferentially round the adapter member and collar member, said collar member covering the transversely extending hole;

a syphon tube in communication with the adapter member, said syphon tube extending within the container and into the liquid;

the bottle being used when the compliant container is squeezed with the top of the bottle extending generally upwardly, whereby the liquid is forced through the syphon tube and out of the container through the anti-syphon means and the nozzle; and the anti-syphon means being effective when a differential exists between the pressures on the inside and the outside of the container for venting air within the container through the circumferentially extending space and the transversely extending hole to equilibrate the inside and outside pressures without said air interacting with the liquid, thereby tending to prevent expulsion of the liquid through the syphon tube, the anti-syphon means and the nozzle when the bottle is not being used.

2. A squeeze type bottle as described by claim 1, wherein:

the bottle is used when the container is squeezed with the top of the bottle extending generally downwardly, whereupon the collar member is displaced to uncover the transversely extending hole and the liquid is forced through said hole and out of the container through the nozzle.

3. In combination with a squeeze type bottle including a compliant container for a liquid, a cap for the container, a nozzle arranged with the cap so as to provide an opening to the container and a syphon tube extending within the container and into the liquid, anti-syphon means comprising:

a first member in communication with the nozzle and with the syphon tube above the liquid:

a hole extending transversely through at least one side of said first member;

a second member surrounding the first member so that a space extends circumferentially around the first and second members, said second member covering the transversely extending hole;

the bottle being used when the compliant container is squeezed with the top of the bottle extending generally upwardly, whereby the liquid is forced through the syphon tube and out of the container through the first member and the nozzle; and the anti-syphon means being effective when a differential exists between the pressures on the inside and the outside of the container for venting air within the container through the circumferentially extending space and the transversely extending hole to equilibrate the inside and outside pressures without said air interacting with the liquid, thereby tending to prevent expulsion of the liquid through the syphon tube, the anti-syphon means and the nozzle when the bottle is not being used.

4. The combination as described by claim 3, wherein:

the bottle is used when the container is squeezed with the top of the bottle extending generally downwardly, whereupon the collar member is displaced to uncover the transversely extending hole and the liquid is forced through said hole and out of the container through the nozzle.

5. A squeeze type bottle, comprising:

a compliant container for a liquid;

a cap for the container;

a nozzle arranged with the cap so as to provide an opening to the container;

anti-syphon means in communication with the nozzle above the liquid;

a syphon tube in communication with the anti-syphon means, said syphon tube extending within the container and into the liquid;

the bottle being used when the compliant container is squeezed with the top of the container extending generally upwardly, whereby the liquid is forced through the syphon tube and out of the container through the anti-syphon means and the nozzle; and the anti-syphon means including a first member having an adapter in communication with the nozzle and the syphon tube with a hole extending transversely through at least one side of the adapter, and a second member having a collar which surrounds the adapter so that a space extends circumferentially around the adapter and the collar, said collar covering the transversely extending hole, said first and second members being arranged for venting air within the container through the circumfernetially extending space and the transversely extending hole when a differential exists between the pressures on the inside and the outside of the container to equilibrate said inside and outside pressures without said air interacting with the liquid, thereby tending to prevent expulsion of the liquid through the syphon tube, the anti-syphon means and the nozzle when the bottle is not being used.

6. A squeeze type bottle as described by claim 5, wherein:

the bottle is used when the container is squeezed with the top of the bottle extending generally downwardly, whereupon the collar is displaced to uncover the hole and the liquid is forced through said hole and out of the container through the nozzle.

* * * * *